US005909197A

United States Patent [19]

Heinemann et al.

[11] Patent Number: 5,909,197

[45] Date of Patent: Jun. 1, 1999

[54] DEPLOYABLE HELICAL ANTENNA STOWAGE IN A COMPACT RETRACTED CONFIGURATION

[75] Inventors: Gary M. Heinemann, Santa Barbara; Christopher D. Pace, Goleta, both of Calif.

[73] Assignee: AEC-Able Engineering Co., Inc., Goleta, Calif.

[21] Appl. No.: 08/832,982

[22] Filed: Apr. 4, 1997

[51] Int. Cl.[6] ..... H01Q 1/36; H01Q 1/08

[52] U.S. Cl. ..... 343/895; 343/880; 343/881

[58] Field of Search ..... 343/895, 900, 343/901, 880, 881; H01Q 1/36, 1/08

[56] References Cited

U.S. PATENT DOCUMENTS

| | | | |
|---|---|---|---|
| 3,699,585 | 10/1972 | Morrison | 343/895 |
| 3,836,979 | 9/1974 | Kurland et al. | 343/895 |
| 3,913,109 | 10/1975 | Owen | 343/895 |
| 4,475,111 | 10/1984 | Gittinger et al. | 343/895 |
| 4,780,727 | 10/1988 | Seal et al. | 343/895 |

*Primary Examiner*—Hoanganh Le
*Attorney, Agent, or Firm*—Donald D. Mon

[57] ABSTRACT

A compressible and deployable antenna includes a top and a bottom plate. A deployable structure is fitted between the plates which can forcibly separate the plates, and place in tension a plurality of foldable unstretchable cords to provide a rigid antenna structure. An antenna conductor is connected to the plates and is coiled around the structure in a helical shape so its convolutions can be brought closer to one another for stowage, and spaced farther apart in deployment.

6 Claims, 2 Drawing Sheets

DEPLOYABLE HELICAL ANTENNA STOWAGE IN A COMPACT RETRACTED CONFIGURATION

FIELD OF THE INVENTION

An antenna which can be stowed in a compact retracted configuration, and then extended to an elongated deployed configuration.

BACKGROUND OF THE INVENTION

There are applications for antennas which function in an elongated configuration, but which must initially be packaged in a retracted configuration of smaller envelope size. A classical application is for spacecraft antennas, where the volume for stowage in flight to orbit is very limited, but which requires a deployed configuration of larger envelope size and length during orbital service. During its service it is deployed positioned outside of the spacecraft, and the stowage envelope limitations no longer apply.

For spacecraft applications, and for most other applications where the antenna of this invention is important, lightness of weight, rigidity in its deployed condition, insensitivity to temperature, and non-conductivity of supporting structure are important requirements.

Reliability of extension to the deployed configuration is another prime requirement. Because of weight limitations, the structural elements must be lightweight. The means to deploy the antenna must be simple in construction, and involve the fewest possible moving or manipulated parts.

It is an object of this invention to provide a lightweight helical antenna which can be compressed to a flattened configuration and reliably be driven to a rigid deployed configuration by simple and reliable force means.

BRIEF DESCRIPTION OF THE INVENTION

A helical antenna according to this invention includes a base plate and a top plate, these plates being parallel and normal to a common central axis. In the stowed (retracted) configuration, they are close together. In the deployed configuration they are axially farther apart. A helical flexible antenna conductor is coiled around the structure, with convolutions which are close together in the stowed configuration, and are wider apart in the deployed configuration.

Axial thrust means is provided to drive the plates axially apart. The extent of axial separation is determined by a plurality of foldable unstretchable cords which are attached to the plates, and which prevent further separation of the plates when they are taut. There results a rigid columnar antenna structure which can be compressed to a small envelope size in opposition to the thrust means, and can be deployed by the thrust means.

According to a preferred but optional feature of the invention, the thrust means is a triangular array of three pantograph assemblies extending between the plates. This pantograph assembly is the presently-preferred thrust means. It is only one of several types of deployable structures that are capable of forcibly separating the antenna end plates.

When utilizing a pantograph, each pantograph assembly comprises a pair of pivotally joined legs which form scissor linkages whose heights change when the legs are pivoted toward or away from each other, thereby to lengthen or shorten the assembly. The legs at both ends of each pantograph are joined together in an equilateral array and to a respective slider fitted in a slot in a respective one of the plates. The slots extend radially, so the joined legs move together toward and away from each other as they move along their slot. All of the pantograph assemblies remain parallel to the axis at all times.

Deployment of this pantograph assembly is caused by force means that force the coupled legs toward the axis by noving the sliders toward the axis.

According to a preferred but optional feature of the invention, the force means comprises a spring-like member in each slot whose bias is toward the axis. Alternatively, drive means such as a screw feed or spring-biased plunger could be used, but could involve complexity and more weight.

The above and other features of this invention will be fully understood from the following detailed description and the accompanying drawings, in which:

DETAILED DESCRIPTION OF THE INVENTION

Figure 1:
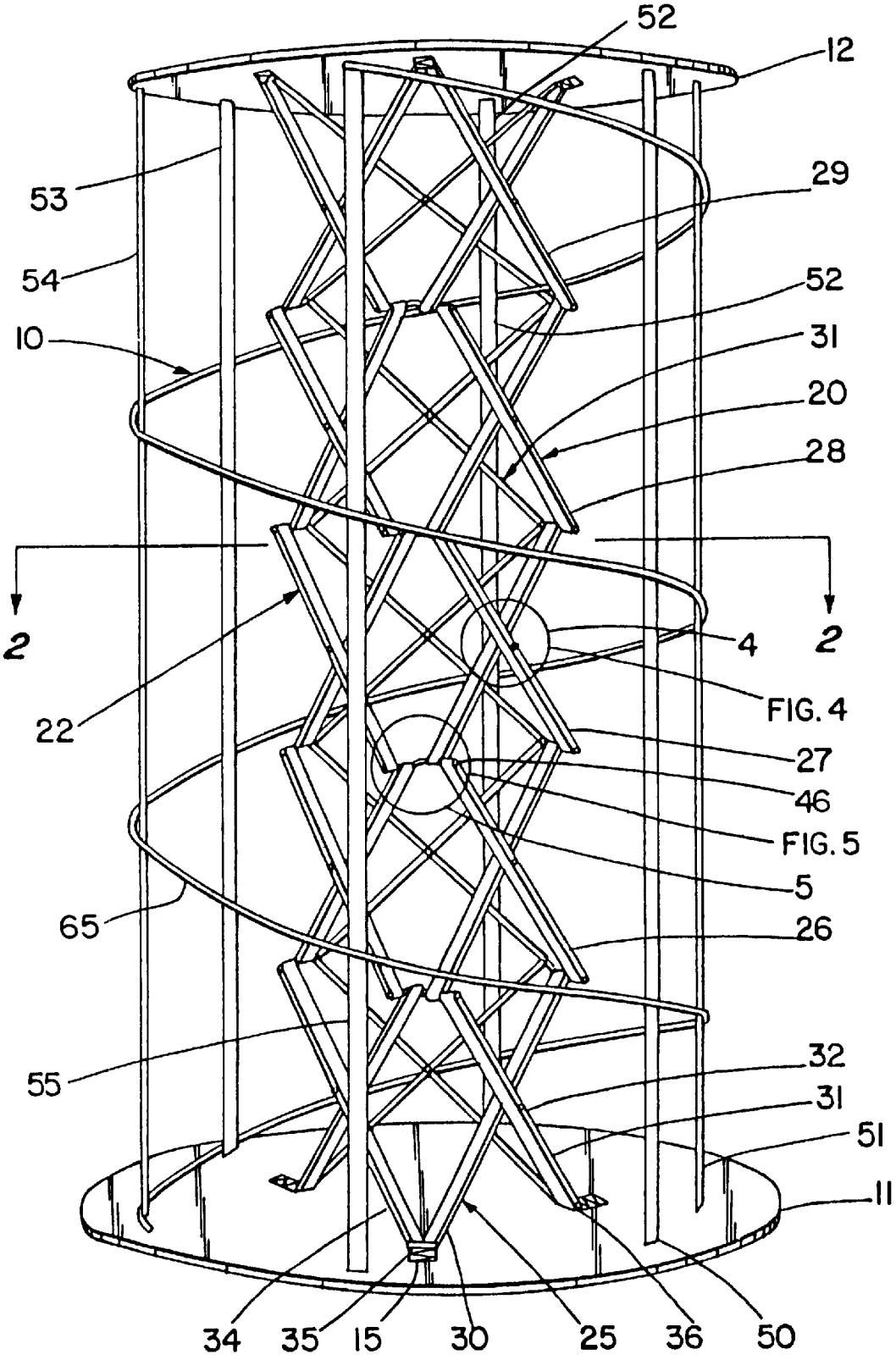
FIG. 1 is a side view of the presently-preferred embodiment of the invention.

FIG. 1 shows the presently-preferred embodiment of this invention in its deployed configuration. This antenna 10 includes a base plate 11 and a top plate 12. These plates are parallel, and are centered on a common central axis 13 (the antenna bore sight). They are mirror images of one another, so that only one is described in detail.

Figure 2:
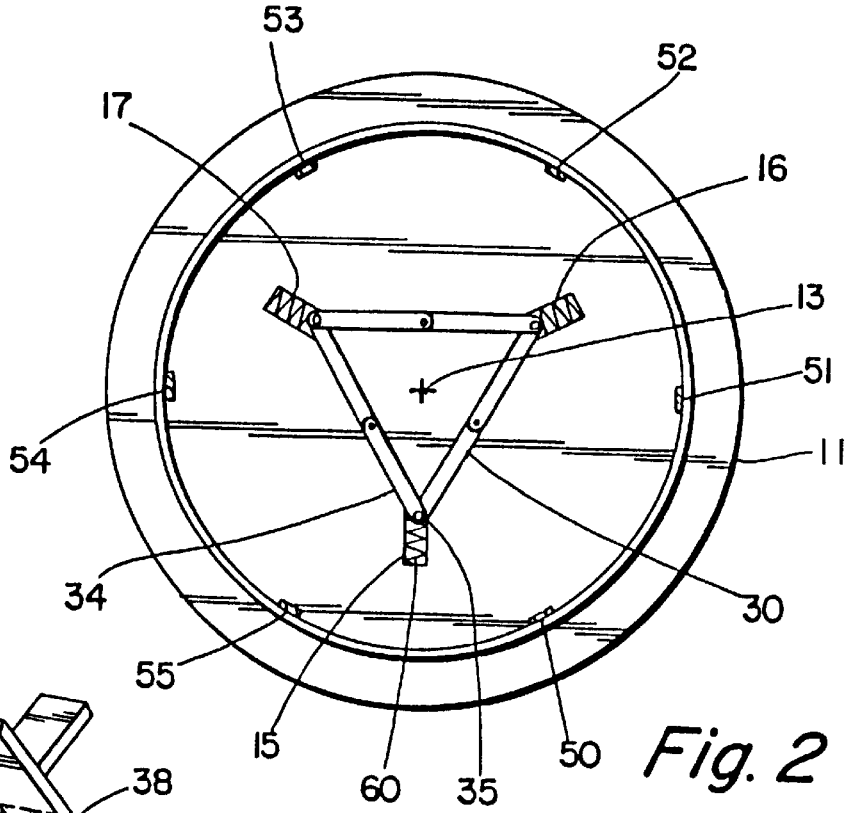
FIG. 2 is a cross-section taken at line 2—2 in FIG. 1.
Figure 4:
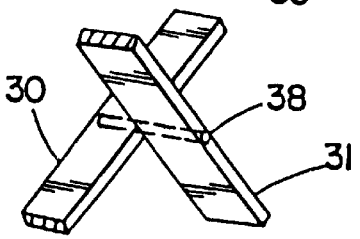
FIG. 4 is a vignette taken at region 4 in FIG. 1.

FIG. 2 is a plan view of bottom plate 11. It includes three guide slots 15, 16, 17. The top plate has three similar slots, which are parallel to those in the base plate. The slots extend in respective radial directions, 120 degrees apart.

Returning to FIG. 1, three identical pantograph assemblies 20, 21 and 22 are shown. Only assembly 20 will be described in detail, because all three are identical. Assembly 20 comprises five scissor linkages 25, 26, 27, 28, 29. These linkages are formed by rigid links 30, 31 pivotally joined by a pivot pin 32. The end links of each assembly are joined to respective plates. The number of linkages is arbitrary, and may be as many or as few as are appropriate to an installation. Also, more than three pantograph assemblies may be used.

The joinder of the links to the plates is an important feature of integrating the pantograph in the deployment of the deployable helical antenna invention. Adjoining links of adjacent pantograph assemblies, for example link 30 of assembly 20 and link 34 of assembly 22 are joined to a slider 35 which rides in slot 15. A similar arrangement exists at all six slots, three on each plate. The sliders include hinge means 36 which enable the respective links to move toward and away from the other link which is pivoted to same slider. The consequence is three pantograph assemblies, each of which remains in its own plane, which plane expands radially outward as the sliders move outwardly in the slots, as the pantograph assemblies shorten. The reverse movement elongates the assemblies.

Figure 3:
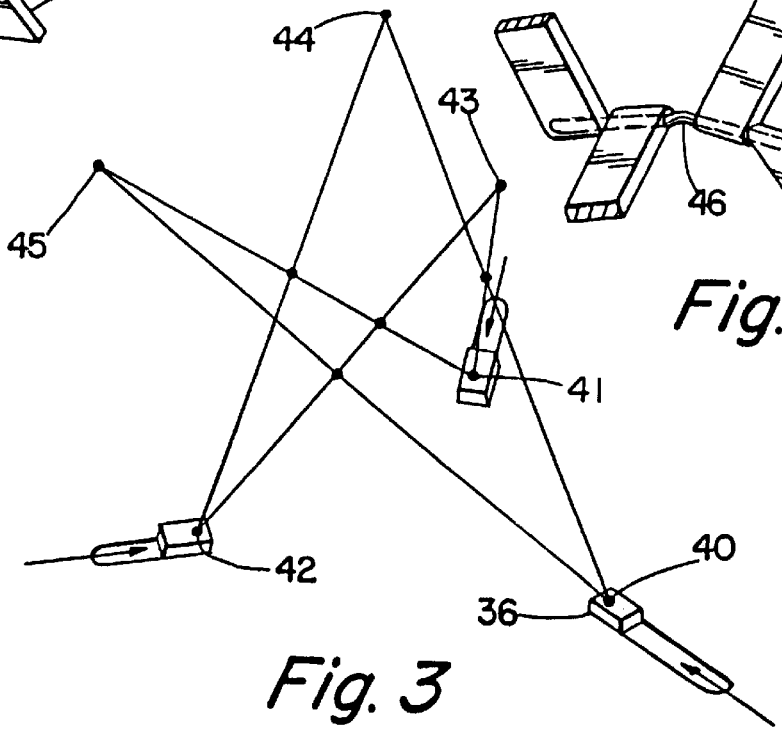
FIG. 3 is a schematic view illustrating some of the movements in this device.

This action is schematically shown in FIG. 3, where points 40, 41 and 42, respective to sliders on the lower plate are shown to correspond to points 43, 44 and 45 on the upper plate. Of course intermediate linkages, are provided which are not shown. However few or many there are, the trios of points will lie in the same respective plane, and the points respective to the plane of each pantograph assembly will be axially aligned.

Figure 5:
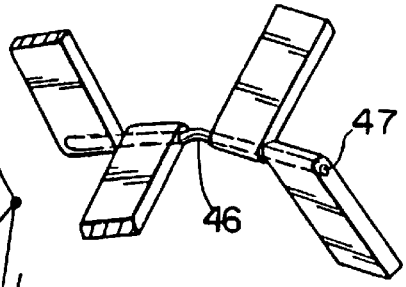
FIG. 5 is a vignette taken at region 5 in FIG. 1.

To provide greater rigidity of the pantograph the intermediate joinders of the scissor linkages are pivoted to the like joinders of their neighbor. An example is shown in FIGS. 1 and 5, where a joinder 46 is formed by a hinge 47 that permits the necessary degrees of freedom. The triangular structure is therefore a monolithic group of interconnected arrays.

Rigidity of the deployed antenna structure is primarily provided by attachment of its convolutions to a group of foldable, essentially unstretchable cords 50, 51, 52, 53, 54 and 55 spaced (for example) 60 degrees apart each joined at its ends to the top and bottom plates. All of them are the same length. Six cords are shown, although there may be more or fewer.

Force means 60, when they exert forces to drive the sliders toward the central axis, cause the pantograph assemblies to extend and exert a separative thrusting force between the plates. When the plates are separated by the limit of the tapes, the prevailing force tends to hold the total device as a rigid tower, resistant to bending or compressive forces.

The force means for deploying the pantographic structure may be any device which can exert a force to drive the slider toward the axis to the limit defined by the cords. Springs are preferred, although mechanical devices such as screw feeds and the like could instead be provided. With a spring, the energy required for deployment is supplied by compressing the antenna to its stowed condition. This is a more reliable source of energy than a mechanical device which requires external power and is thereby more complicated.

Again it is emphasized that other deployable structure force means may also be utilized to separate the antenna's end plates and tension the relatively unstretchable cords to which the antenna is secured. Examples include coilable thrust booms and extensible reeled-out tubes.

All parts of this antenna, except conductor 65 and base plate 11 can be made of lightweight, thermally stable and non-conductive material. The base plate is usually the ground plane for the antenna. The structure is simple in construction and highly reliable.

Should retractability be desired, which will rarely be the situation, a powered lanyard can be fitted between the plates to draw them toward one another or a motor driving the sliders outwards to accomplish the same task. It will be noticed that antenna conductor 65 is secured at each of its intersections with the cords. When the antenna is deployed, the taut cords arrange the conductor in a correct helix. When the antenna is compressed, the cords will fold to enable the coiled conductor to change its radius appropriately. The conductor is usually conductively connected to the base plate if the plate is to be part of the circuitry. It will be structurally connected to both plates.

This invention is not to be limited by the embodiment shown in the drawings and described in the description, which is given by way of example and not of limitation, but only in accordance with the scope of the appended claims.

We claim:

1. An antenna adapted to be compressed to a stowed configuration and elongated to a deployed configuration, comprising:

a top plate and a bottom plate, said plates being normal to a common axis of extension, each plate having a face facing the other, at least three slots in each of said faces extending radially, disposed symmetrically apart;

a plurality of foldable, unstretchable inelastic cords attached to and extending between said plates, said cords being taut and in tension when said plates are at their maximum spacing from each other;

a flexible helical antenna conductor attached to each of said plates and coiled in convolutions around said axis;

an equal number of pantograph assemblies, each said assembly being formed of a plurality of parts of crossed links, the links of each pair being hinged together at their mid-points, the ends of the links adjacent to each plate being hingedly connected to a respective slider, each slider being slidably fitted in a respective one of said slots said assemblies lying in respective axially extending planes which include their respective slots, with said ends of said links of adjacent assemblies being joined to the same slider; and force means for forcing said sliders toward said axis, whereby to move the ends of each pair toward one another, thereby to elongate said assemblies, and separate said plates to place said cords in tension, and increase the spacing apart of the convolutions of the antenna and thereby the axial length of the helical antenna.

2. An antenna according to claim 1 in which said force means is a spring in each slot so disposed and arranged as to bias said sliders toward said axis.

3. An antenna according to claim 2 in which the number of slots in each plate and the number of pantograph assemblies is three, and they are disposed 120 degrees apart.

4. An antenna according to claim 2 in which said cords are attached to said convolutions at spaced apart locations along each tape.

5. An antenna according to claim 1 in which the number of slots in each plate and the number of pantograph assemblies is three, and they are disposed 120 degrees apart.

6. An antenna according to claim 1 in which said cords are attached to said convolutions at spaced apart locations along each tape.

* * * * *